US006047847A

United States Patent [19]

Scott

[11] Patent Number: 6,047,847

[45] Date of Patent: Apr. 11, 2000

[54] TIPPABLE SAFETY CONTAINER

[76] Inventor: Charles Winfield Scott, 8575 Bridgewater La., Cincinnati, Ohio 45243

[21] Appl. No.: 09/128,175

[22] Filed: Aug. 3, 1998

[51] Int. Cl.[7] ..... B65D 25/24; B65D 90/12

[52] U.S. Cl. ..... 220/631; 215/373; 220/606; 220/636; 248/349.1

[58] Field of Search ..... 220/605, 606, 220/608, 628, 629, 630, 729, 636, 631; 215/372, 373, 376, 377, 395; 248/133, 143, 144, 145, 349.1, 346.4, 346.5, 910

[56] References Cited

U.S. PATENT DOCUMENTS

| | | | |
|---|---|---|---|
| 185,435 | 12/1876 | Evans | 220/635 X |
| 1,301,694 | 4/1919 | Healy | 220/631 |
| 1,331,372 | 2/1920 | Popper | 220/630 X |
| 2,793,788 | 5/1957 | Lysne | 220/631 |
| 3,083,888 | 4/1963 | Miller | 220/635 X |
| 3,127,698 | 4/1964 | Smithers | 248/246.5 X |
| 3,272,094 | 9/1966 | Carpenter, Jr. | 206/518 X |
| 3,434,625 | 3/1969 | Embry, Jr. | 206/518 X |
| 3,543,922 | 12/1970 | Charlton | 220/635 X |
| 3,615,039 | 10/1971 | Ward . | |
| 3,739,939 | 6/1973 | Koenig . | |
| 3,885,698 | 5/1975 | Lebel et al. | 220/631 |
| 4,175,670 | 11/1979 | Reynolds | 220/606 |
| 4,341,321 | 7/1982 | Gombas | 220/608 X |
| 4,442,944 | 4/1984 | Yoshino et al. | 220/605 X |
| 4,534,466 | 8/1985 | Wood . | |
| 4,552,275 | 11/1985 | Chang et al. | 220/605 X |
| 4,616,752 | 10/1986 | Ridgley | 220/628 X |
| 4,726,490 | 2/1988 | Bonnema et al. . | |
| 4,878,590 | 11/1989 | Porter . | |
| 5,072,841 | 12/1991 | Okhai | 220/608 X |
| 5,183,179 | 2/1993 | Morris, Sr. . | |
| 5,360,133 | 11/1994 | Corbey et al. | 220/635 X |
| 5,392,916 | 2/1995 | Paulison . | |
| 5,423,452 | 6/1995 | Tardif | 220/631 X |
| 5,513,770 | 5/1996 | Seeley et al. . | |
| 5,577,632 | 11/1996 | Blanchette et al. . | |
| 5,641,087 | 6/1997 | Moffitt . | |

FOREIGN PATENT DOCUMENTS

| | | |
|---|---|---|
| 882528 | 5/1953 | Germany . |

*Primary Examiner*—Allan N. Shoap
*Assistant Examiner*—Joe Merek
*Attorney, Agent, or Firm*—Thompson Hine & Flory LLP

[57] ABSTRACT

A tippable safety container for shipping and storage of various goods, and for preventing accidental child drownings, comprising a bucket having at least one extension extending from the bottom thereof having a footprint smaller than the footprint of the bottom of the bucket. The container includes a removable lid that is shaped to nestably receive and support a similarly shaped bottom of another container. Preferably, the extension is cylindrical in shape and the bucket has a cylindrically shaped sidewall. In a preferred embodiment, a plurality of extensions in a concentric array extend from the bottom of the bucket.

10 Claims, 8 Drawing Sheets

TIPPABLE SAFETY CONTAINER

BACKGROUND OF THE INVENTION

This invention relates to containers or buckets for storage of bulk or commercial quantities of generally liquid products, and more particularly, to containers for liquids designed to minimize the likelihood of child drowning.

Numerous small children, such as toddlers, drown every year by falling into open containers of water or other liquids. For the most part, the containers involved in such deaths are standard five gallon open head industrial storage buckets which were kept for usage by a homeowner for household use, such as to hold paint or a liquid cleaning solution. A drowning typically occurs when a curious child, left unattended for a short while, crawls or walks to the edge of the container and pulls himself/herself up to the rim. Looking inside, the child is attracted to the contents, or perhaps drops a toy into the container, and upon reaching in to play in the liquid or retrieve the object loses his balance and tumbles head first into the container. Due to the wide base and inherent stability of standard industrial buckets, in all likelihood the center of gravity of the contents (liquid plus child) will be positioned such that it is very difficult for the child to tip the bucket. As a result, unless an older child or adult were to discover the situation in a relatively short amount of time, severe injury or death may result.

Some surveys have indicated that as many as 40 young children a year in the United States alone die from mishaps such as these. In fact, given that the number of do-it-yourself homeowners continues to increase, that only a small amount of liquid need be present in the bucket to pose a significant drowning risk, and that a small child has a great deal of his weight distributed in the upper part of his body, it may only be a matter of time before more deaths of this nature occur.

Ways for preventing children from accidentally drowning in standard industrial buckets are known. For example, U.S. Pat. No. 5,183,179 to Morris, Sr. discloses a container having a hollow projection protruding up from the base into the interior of the bucket to a height at least one half of the height of the bucket, thereby preventing a larger child from sticking his head all the way in the bucket. However, in the Morris, Sr. product, a smaller child could still fit its body in the bucket despite this projection, and since the bucket of the Morris, Sr. invention has a footprint similar to that of a standard industrial bucket, it is no less difficult to tip. Also, since the projection protrudes through the interior of the bucket, a significant amount of the bucket's storage volume is lost.

U.S. Pat. No. 5,577,632 to Blanchette et al. discloses an apparatus for preventing accidental drowning of children utilizing a ring having various sized cutouts which is attached to the top of an otherwise standard bucket. However, in the Blanchette et al. invention, as in the Morris, Sr. invention, nothing is done to increase the tippability of the bucket, and thus if a smaller child were to slip through one of the larger cutouts, he would be unable to tip the bucket to get out or spill the contents away from his nose and mouth. Furthermore, the cutouts in the ring attachment restrict access to the bucket, making it difficult for a user to access the contents of the bucket.

Accordingly, a need exists for a container for preventing accidental drowning of children which has a certain degree of inherent stability when in use, yet which is easily tippable by a child who may tumble in head first.

SUMMARY OF THE INVENTION

The present invention is a tippable safety container for shipping and storage of various goods, and for further household uses, comprising a bucket having at least one extension extending from the bottom thereof having a footprint smaller than the footprint of the bottom of the bucket. The container includes a removable lid that is shaped to nestably receive and support the similarly-shaped bottom of another container. Preferably, the extension is cylindrical in shape and the bucket has a cylindrically-shaped side wall. In a preferred embodiment, a plurality of extensions in a concentric array extend from the bottom of the bucket. Preferably, these extensions vary in height from the shortest, located closest to the side wall of the bucket, to the longest, located closest to the center of the bucket, thereby creating a "tipping curve" that promotes tipping at a desired "tipping force." Depending on the spacing, number and height of the extensions, containers can be designed having optimal tipping curves such that tipping occurs at different desired tipping forces.

In an alternate embodiment of the present invention, the container is provided with a spherically shaped bottom having a flat portion at the center. Thus, once tipping has been initiated, the container continues to tip along the smooth, continuous curved portion of the bottom. In this embodiment, the area of the flat portion can be varied to alter the tipping force required to initiate tipping. In yet a further embodiment, a similar continuous tipping tangent can be created by mounting a plurality of rounded fins on the bottom of the bucket. These fins have flat portions located at the points farthest from the bottom of the bucket to provide some degree of inherent stability and are spaced evenly around the bottom of the bucket.

Accordingly, it is an object of the present invention to provide an open top container for liquids, which may be used safely for household chores, which has a certain degree of inherent stability yet is easily tippable when a child accidentally tumbles into the interior of the container; which includes a removable lid that is shaped to nestably receive the bottom of a similarly shaped container; a container which, when the lid is removed, has a substantially open head allowing easy accessability to the contents inside; and which is relatively inexpensive and easy to fabricate.

Other objects and advantages of the present invention will be apparent from the following description, the accompanying drawings and the appended claims.

DETAILED DESCRIPTION

Figure 1:
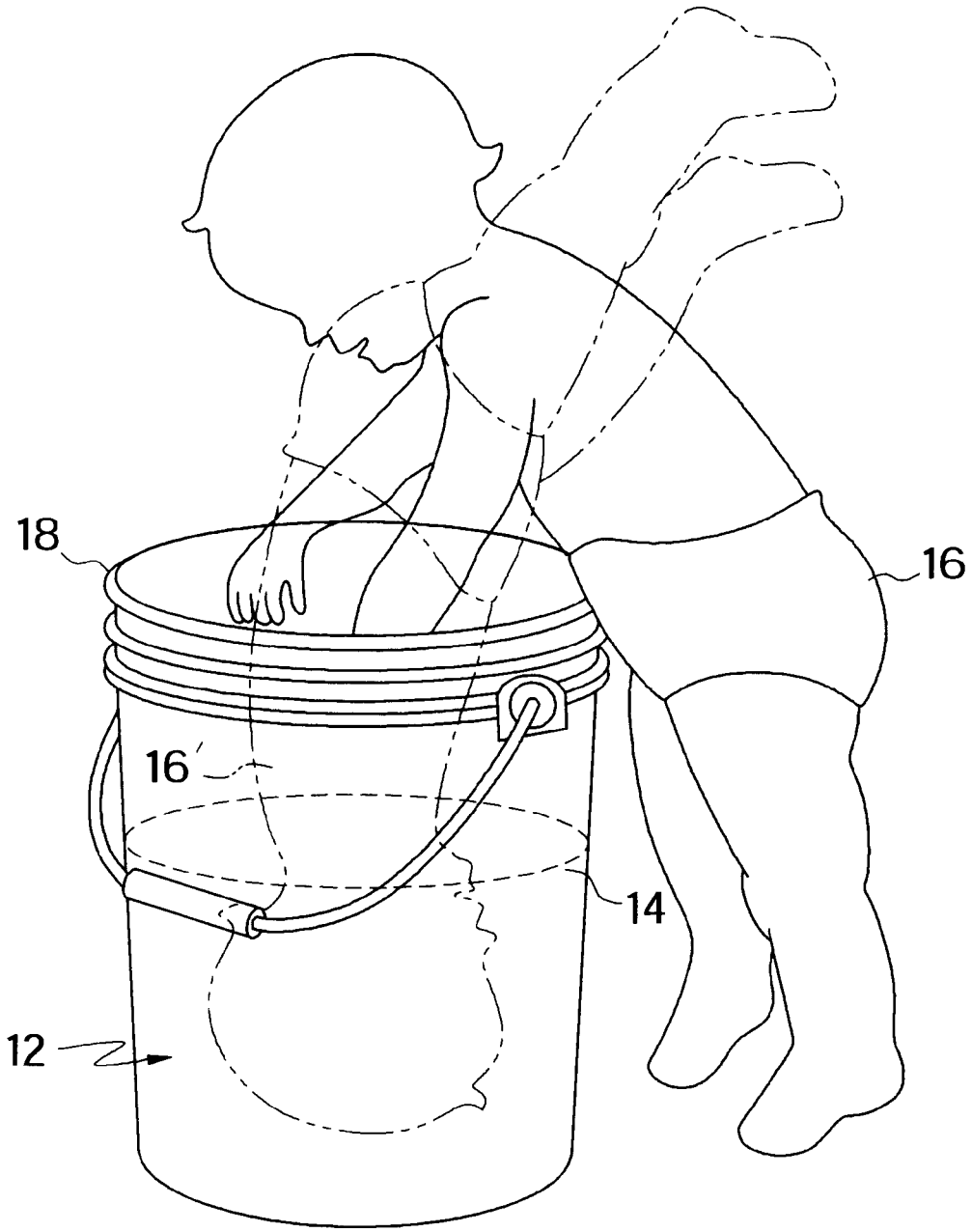
FIG. 1 PRIOR ART
FIG. 1 is a perspective view of a partially filled prior art container illustrating a child reaching and falling into the container.

As shown in FIG. 1, a prior art five-gallon open head industrial container 12, partially filled with a liquid such as water 14 attracts a curious young child 16. The child 16 walks or crawls to the container 12 and leans over the rim 18 to peer into the container, or maybe to reach for an inadvertently dropped toy. Due to the weight of the child 16 being distributed mostly in the upper part of his body, it is likely that the child 16 will lose his balance, pivoting over the rim 18, losing his footing and falling head first into the container 12. The child 16', now upside down in the container 12, does not have the strength to properly back himself out of the container 12. Furthermore, due to the location and weight of the water 14 and the child 16', the center of gravity of both (water 14 plus child 16') is probably not located in a position where it is possible to cause the container 12 to tip, which would free the child 16'. Accordingly, unless the child 16' is found in this state quickly, serious injury or drowning may result.

Figure 2:
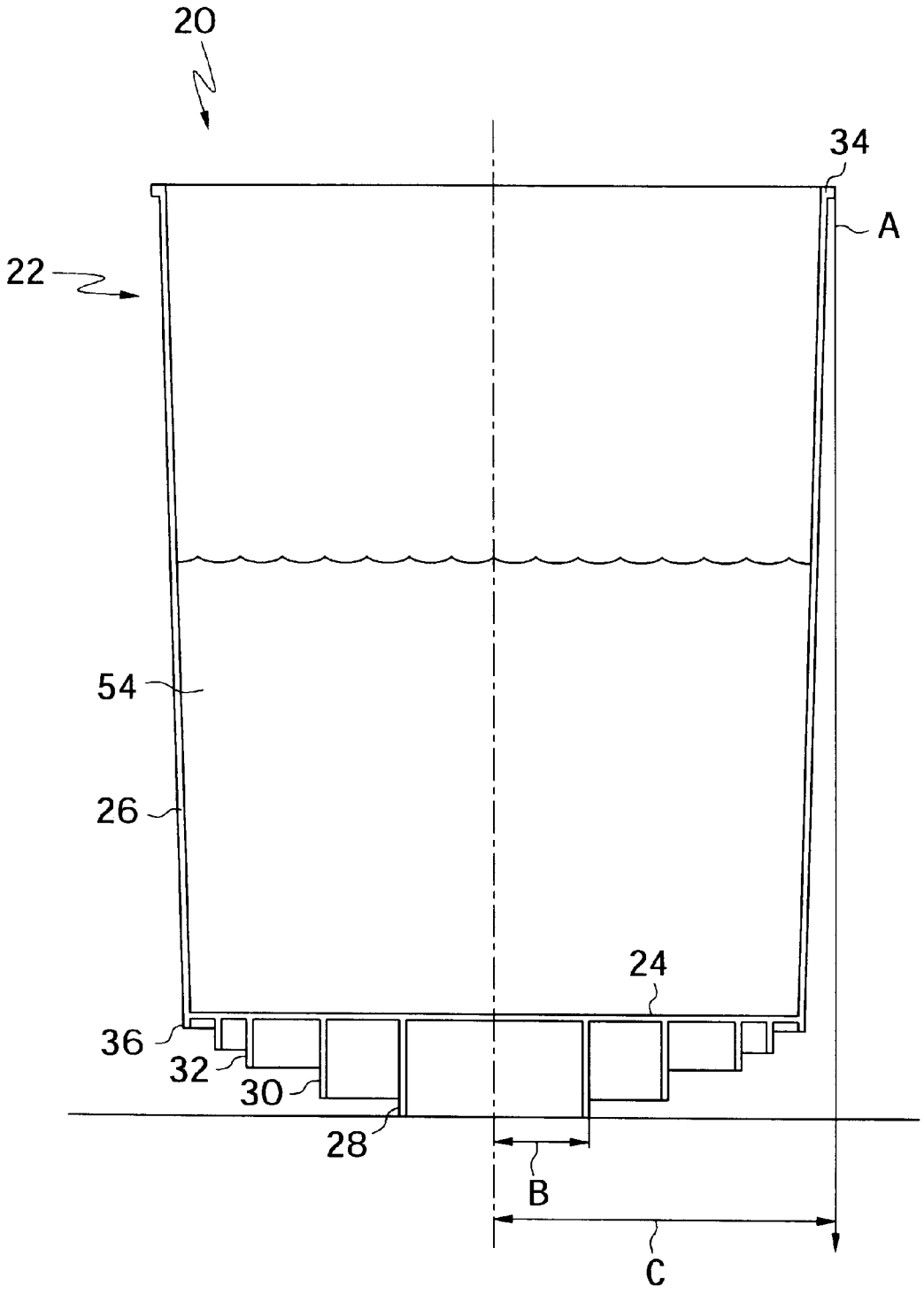
FIG. 2 is a side elevational view in section of a preferred embodiment of a partially filled tippable safety container of the present invention.

The present invention has been developed to prevent injuries such as this from occurring. As shown in FIG. 2, in accordance with a preferred embodiment of the present invention, a tippable safety container, generally designated 20, includes a bucket 22 having a bottom 24 and a cylindrical side wall 26 extending upwardly therefrom. At least one extension 28 is provided and extends downwardly from the bottom 24 of the bucket 22, although preferably additional extensions 30, 32 are also utilized and similarly extend from the bottom of the bucket 22. In a preferred embodiment, the bottom 24, side wall 26, and extensions 28, 30, 32 are all cylindrical in shape.

The side wall 26 terminates in upper and lower rims 34, 36, respectively. The extensions 28, 30, 32 extend from the bottom 24 of the bucket 22 in a concentric, spaced array and are successively shorter in length, progressing from the center of the bottom 24 (extension 28) to the outer periphery of the bottom 24 (extension 32). Preferably, all of the components of the container 20 are integrally formed from an appropriate material, such as polyethylene or polypropylene.

Figure 3:
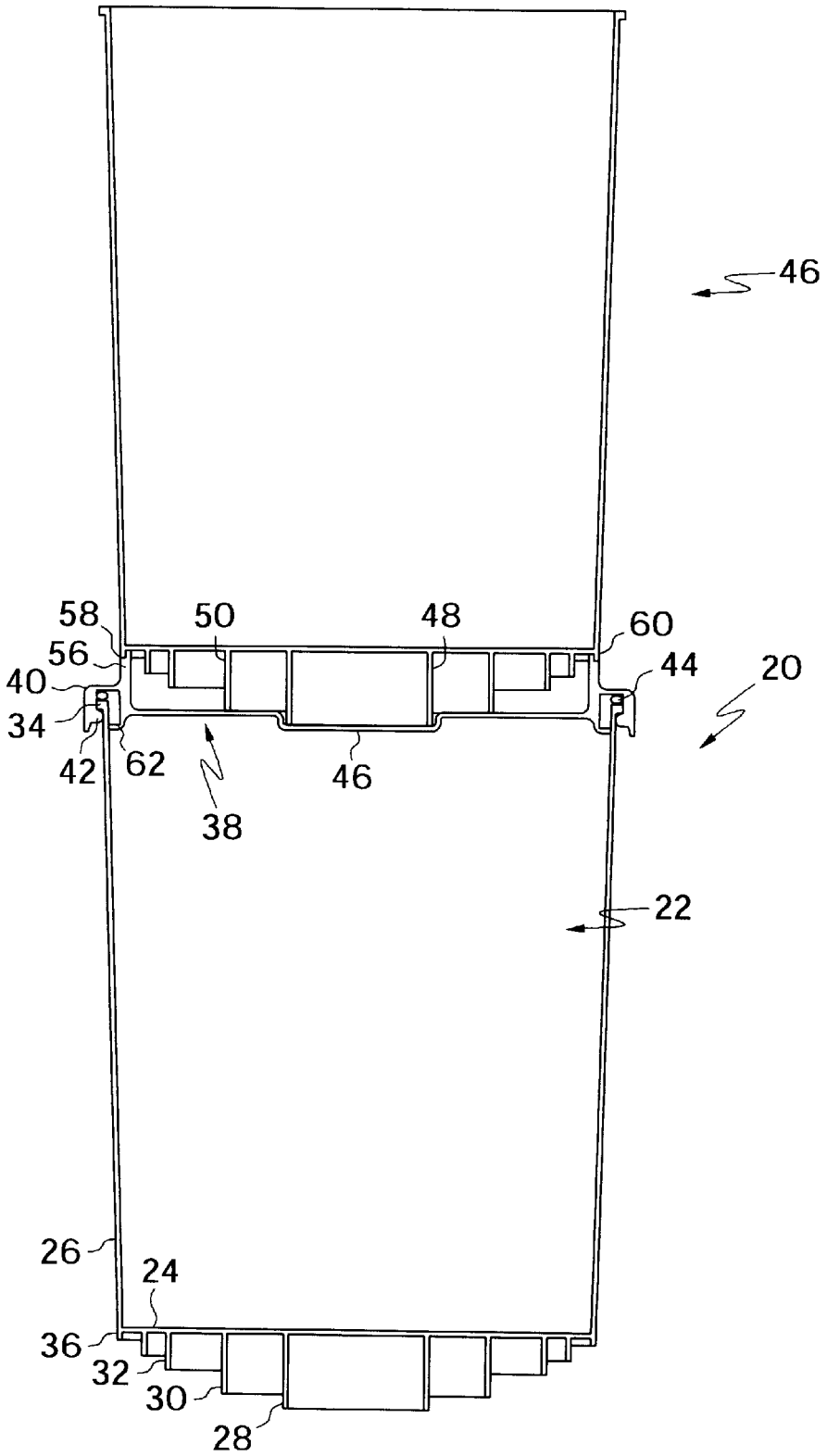
FIG. 3 is a side elevational view in section of a preferred embodiment of two nested tippable safety containers of the present invention.

As shown in FIG. 3, the tippable safety container of the present invention is provided with a lid 38 which preferably is molded from the same material as the bucket 22. The lid 38 includes a flange 40 which extends around the outer periphery of the upper portion of the side wall 26. The flange 40 has an inwardly-facing protrusion 42 which receives the bead of the rim 34 in an interference fit to prevent the lid 38 from inadvertently detaching from the bucket 22. The flange 40 is flexible and it may be displaced, thereby clearing the protrusion 42 from engagement with the rim 34 so that the lid 38 may be removed from the bucket 22. An O-ring type seal 44, preferably made from an elastomeric material, is seated between the rim 34 and the outer periphery of the lid 38 to prevent any leaking of the contents of the bucket 22 during shipping or storage.

The lid 38 is shaped to nestably receive a bottom of a similar safety container 46. The lid 38 includes a central depression 48 sized to accept an extension 50 from nesting container 46. This depression forms a ledge 52 which provides some support for extension 50. Most of the support, however, for the nesting container 46 is provided by the support ring 56 which protrudes upwardly from the lid 38 at a position inward of the flange 40. The support ring 56 includes a ridge 58 on which the lower rim 60 of the nesting container 46 rests. An expansion ring 62 is located below the support ring 56 and contacts the inner upper portion of sidewall 26 to help distribute the weight of nesting container 46 and prevent bowing of the lid 38.

Figure 10:
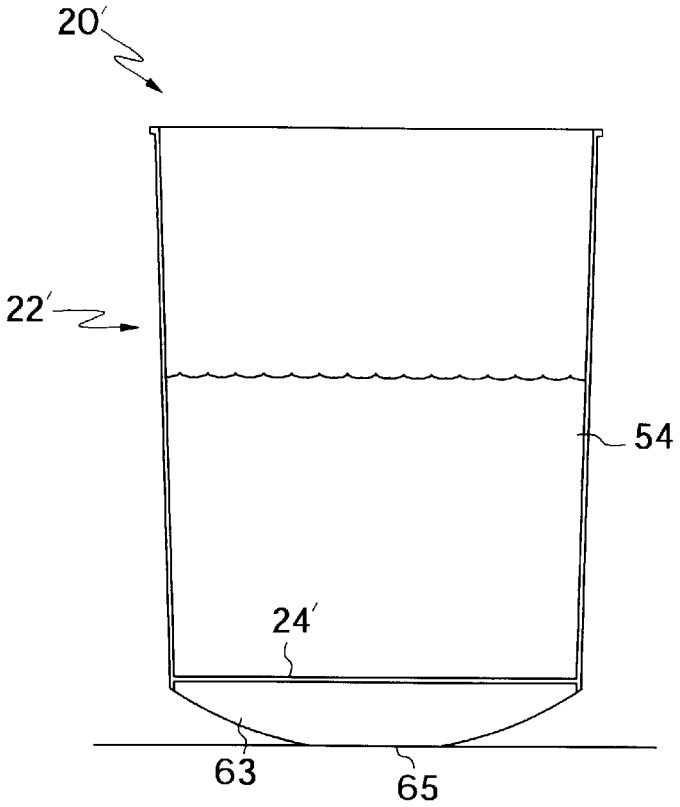
FIG. 10 is a side elevational view in section of an alternate embodiment of a partially filled tippable safety container of the present invention.

In an alternate embodiment, the container 20', as shown in FIG. 10, has a generally spherically shaped extension 63 which extends from and covers the bottom 24' of the bucket 22'. The extension 63 includes a flat portion 65 on which the bucket 22' rests, and which provides a certain degree of inherent stability to the container 20'. However, once tipping begins, it proceeds on a continuous tangent along the circumference of the spherically shaped extension 63. Preferably, a lid is also provided to nestably receive a similarly shaped bottom of another container.

Figure 11:
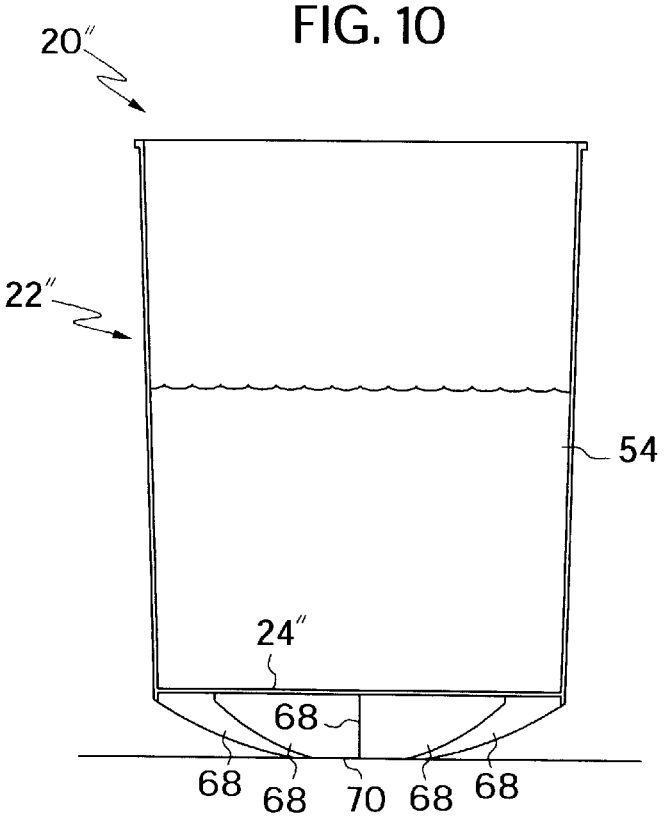
FIG. 11 is a side elevational view in section of an additional alternate embodiment of a partially filled tippable safety container of the present invention.
Figure 12:
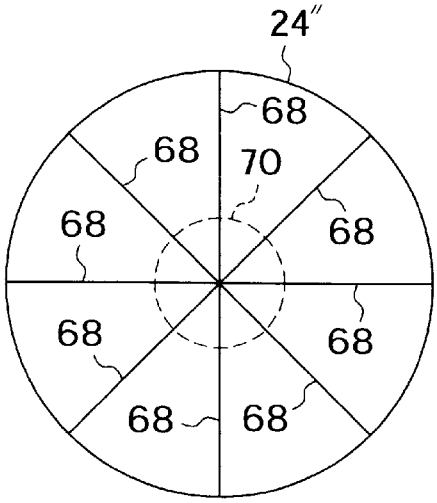
FIG. 12 is a bottom plan view of the alternate embodiment of the tippable safety container of FIG. 11.
Figure 13:
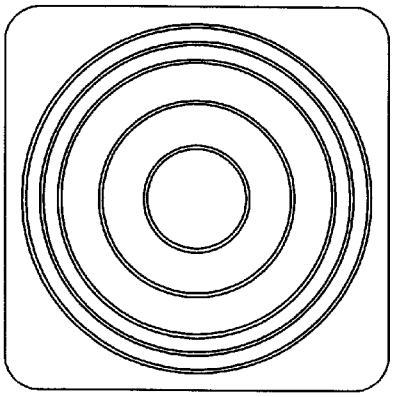
FIG. 13 is a bottom plan view of an alternate embodiment of the tippable safety container of FIG. 11.
Figure 14:
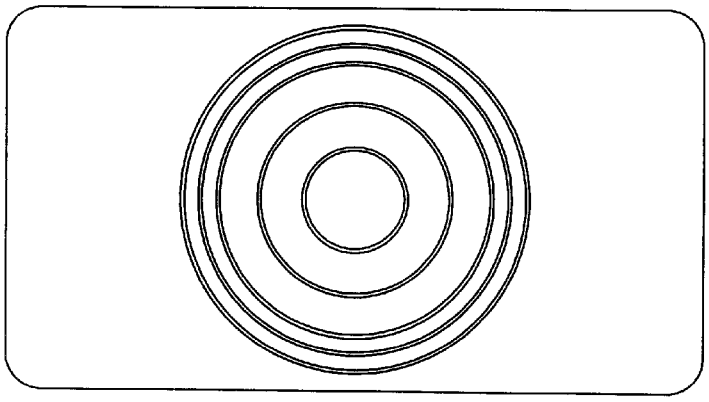
FIG. 14 is a bottom plan view of an alternate embodiment of the tippable safety container of FIG. 11.

In yet a further alternate embodiment 20", as shown in FIGS. 11 and 12, fin shaped extensions 68 extend from the center of the bottom 24" of the bucket 22". The fin shaped extensions include a flat portion 70 on which the bucket 22" rests, and which provides a certain degree of inherent stability to the container 20". However, as in the embodiment depicted in FIG. 10, once tipping begins it proceeds on a continuous tangent along the circumference of the fin shaped extensions 68. Preferably, a lid is also provided to nestably receive a similarly shaped bottom of another container. Although the embodiment depicted in FIGS. 11 and 12 show eight fin shaped extensions 68 extending from the bottom 24" of the bucket 22", it would be apparent to one of ordinary skill in the art that almost any number of extensions could be effectively utilized within the scope of the present invention.

Figure 4:
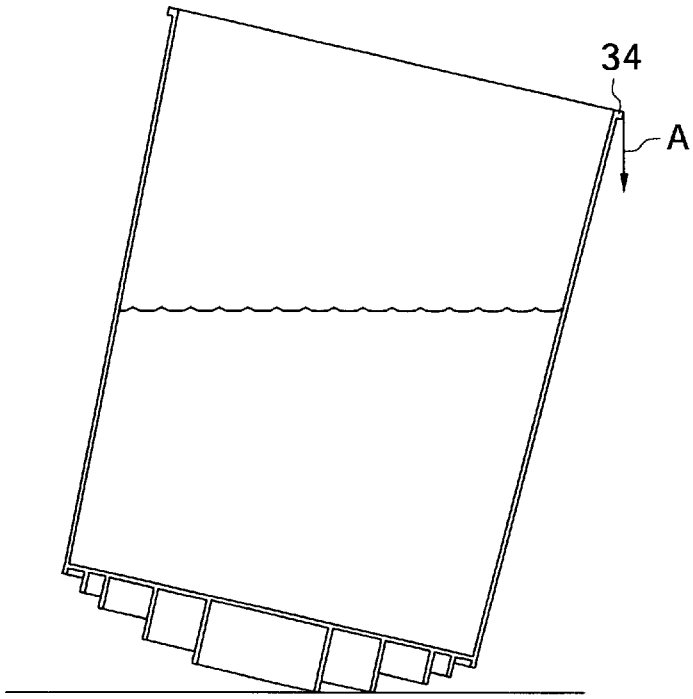
FIG. 4 is a side elevational view in section of a preferred embodiment of a partially filled tippable safety container of FIG. 2 as it begins to tip.
Figure 9:
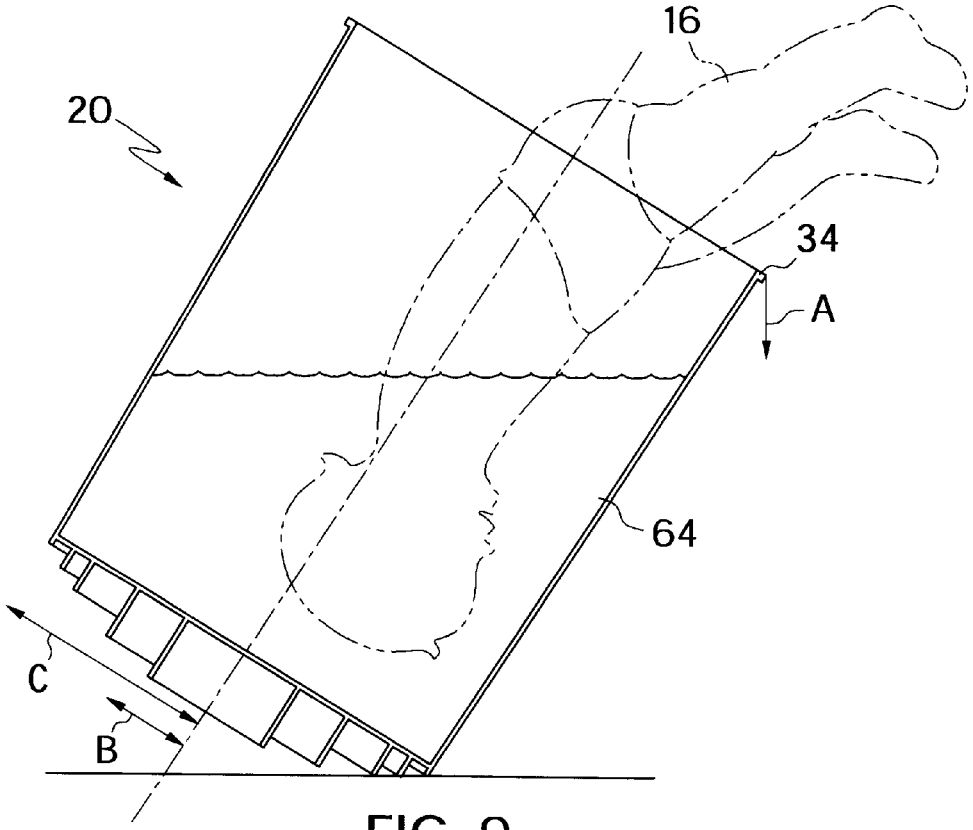
FIG. 9 is a side elevational view in section of a preferred embodiment of a partially filled tippable safety container of the present invention illustrating a child tipping the container.

As shown in FIG. 2, the operation of the tippable safety container of the present invention is as follows. A safety container 20, partially filled with water 54, is subjected to an initial tipping force A at the rim 34. If the force on the rim 34 at the point farthest from the center of gravity of the container 20 is greater than the weight of the container plus its contents times the radius B of the extension that the container is resting on divided by the radius C from the bottom of the bucket to the farthest point on the rim 34 minus the radius B, or:

$$F = \frac{B \cdot (W_t)}{C - B} \tag{1}$$

then the container will begin to tip, as shown in FIG. 4. Furthermore, as shown in FIGS. 5–8, the container will continue to tip so long as force A continues to be greater than the value calculated from equation (1) for each tipping point provided by each extension. Thus, as shown in FIG. 9, when a small child 16 accidentally falls forward into the container 20 of the present invention, the container 20 will easily tip, causing the water 54 to spill out, thereby preventing the child 16 from drowning.

EXAMPLE

For example, assuming an initial weight for the contents (water plus child) of a container 12 having a radius of 6.00 inches to be 40 pounds 4 ounces, the initial tipping force required for a standard 5-gallon container would be around 40 pounds (?)

However, with the container 20 of the present invention, assuming the same initial weight of 40 pounds 4 ounces for the contents (water plus child) of the container, a radius of 1.55 inches from the center of the container to the edge of the first extension 18, and a distance of 6.00 inches from the center of the container to the rim 26, the initial tipping force required to tip the container 20 (as shown in FIG. 2) would be 14.0 pounds.

$$F = \frac{(1.55\text{ in})(40.25\text{ lbs})}{(6.00\text{ in} - 1.55\text{ in})} = 14.0\text{ lbs} \quad (3)$$

Similarly, by continually using equation (1) after recalculating the distance from the center of the tipping container 20 to the rim 34 and taking into account the loss of some water 54 due to the inclination of the side wall 26, required tipping forces for each tipping point can be calculated. Thus, for the container of the present example, the second tipping force required to tip the container 20 (as shown in FIG. 4) is calculated to be 2.8 pounds.

$$F = \frac{(0.514\text{ in})(36.15\text{ lbs})}{(7.105\text{ in} - .514\text{ in})} = 2.8\text{ lbs} \quad (4)$$

Figure 5:
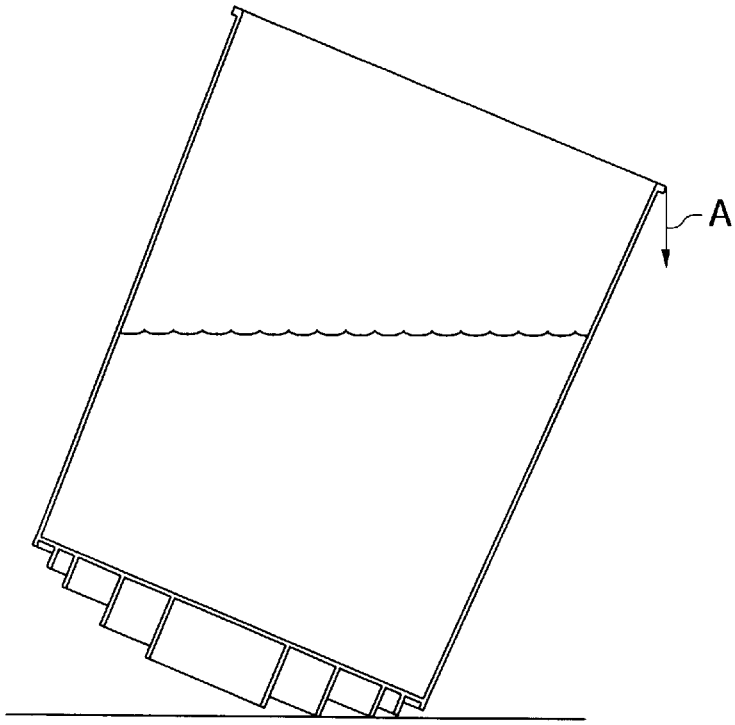
FIGS. 5–7 are side elevational views in section of a preferred embodiment of a partially filled tippable safety container of FIG. 2 as it continues to tip.

The third tipping force required to tip the container 20 (as shown in FIG. 5) is calculated to be 3.5 pounds.

$$F = \frac{(0.762\text{ in})(33.76\text{ lbs})}{(8.084\text{ in} - 0.762\text{ in})} = 3.5\text{ lbs} \quad (5)$$

Figure 6:
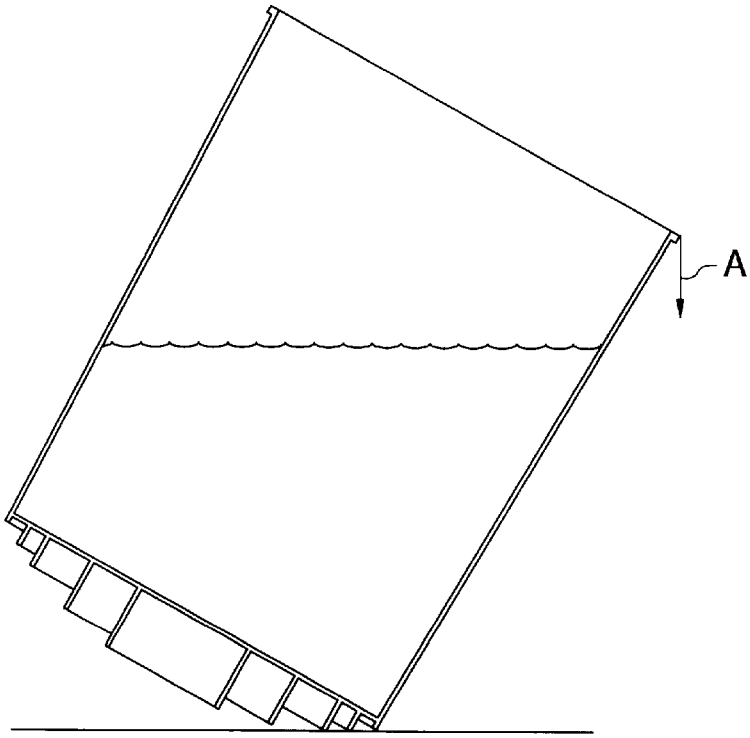

The fourth tipping force required to tip the container 20 (as shown in FIG. 6) is calculated to be 2.1 pounds.

$$F = \frac{(0.534\text{ in})(32.14\text{ lbs})}{(8.646\text{ in} - 0.534\text{ in})} = 2.1\text{ lbs} \quad (6)$$

Figure 7:
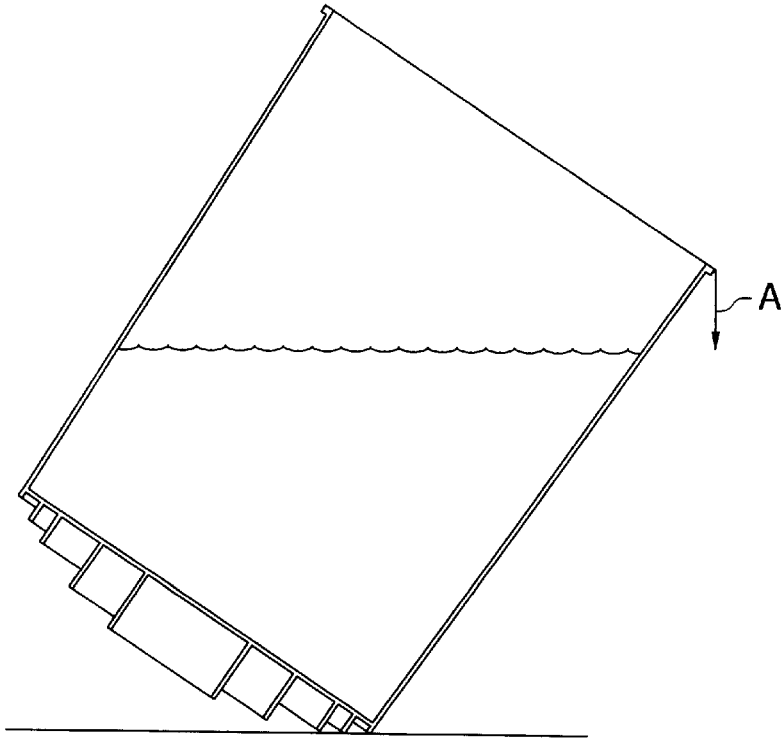
Figure 8:
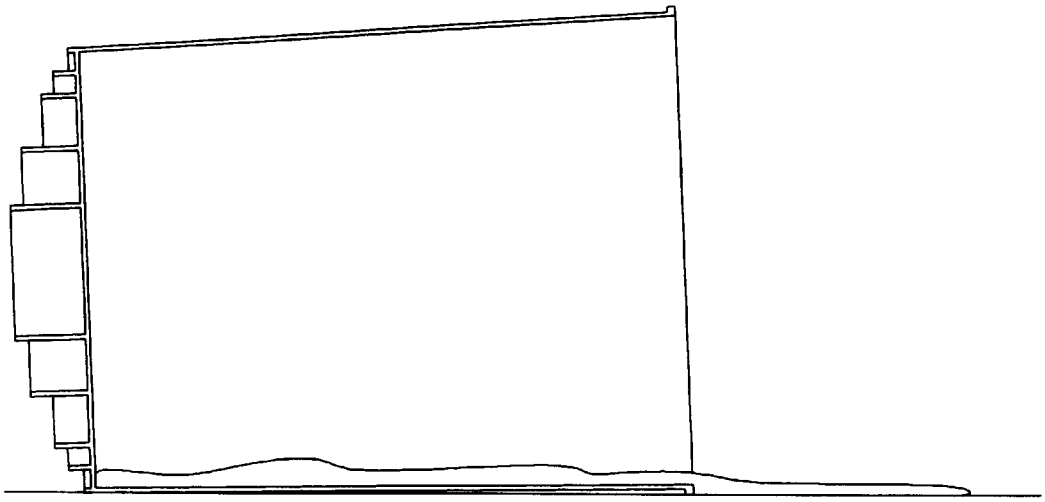
FIG. 8 is a side elevational view in section of a preferred embodiment of a partially filled tippable safety container of FIG. 2 fully tipped over.

The fifth and final tipping force required to completely tip the container 20 (as shown in FIG. 7) is calculated to be 1.5 pounds.

$$F = \frac{(0.437\text{ in})(30.72\text{ lbs})}{(9.110\text{ in} - 0.437\text{ in})} = 1.5\text{ lbs} \quad (7)$$

While the form of the apparatus herein described constitutes a preferred embodiment of the invention, it is to be understood that the invention is not limited to the precise form of apparatus, and that changes may be made therein without departing from the scope of the invention.

What is claimed is:

1. A storage bucket for preventing accidental child drowning comprising:

a bucket having a bottom and at least one sidewall defining an outer periphery of said bucket, said bottom being substantially planar from a center point of said bottom to said outer periphery defined by said sidewall;

at least two separate extensions depending downwardly from said planar bottom, said extensions varying in length and having a footprint smaller than the bottom of said bucket and said extensions positioned on said planar bottom such that the longest is positioned the closest to said bottom center point and said extensions decrease in length continuing outward from said center point to said outer periphery; and wherein said bucket rests upon said longest extension such that when a child falls into said bucket, the distribution of the weight of said child in said bucket is sufficient to tip over said bucket.

2. The storage container of claim 1 wherein said extension is generally cylindrical in shape.

3. The storage container of claim 1 wherein said bucket has one generally cylindrically shaped side wall.

4. The storage container of claim 1 wherein said bucket has four side walls forming a generally square shape.

5. The storage container of claim 1 wherein said bucket has four side walls forming a generally rectangular shape.

6. The storage container of claim 1 wherein said bucket has one generally conically shaped side wall.

7. The storage container of claim 2 including a plurality of extensions spaced in a concentric array.

8. The storage bucket of claim 1 further including a removable lid.

9. The storage bucket of claim 1 wherein said removable lid is shaped to nestably receive a similarly shaped bottom of another container.

10. A method for using the bucket of claim 1 wherein when a child falls into said bucket the weight of said child in said bucket is sufficient to tip over said bucket.

* * * * *